United States Patent [19]

Hibbard

[11] 4,012,909

[45] Mar. 22, 1977

[54] HAMMER

[76] Inventor: George A. Hibbard, R.D. No. 2, Claremont, N.H. 03743

[22] Filed: Nov. 28, 1975

[21] Appl. No.: 636,006

Related U.S. Application Data

[62] Division of Ser. No. 478,289, June 11, 1974, abandoned.

[52] U.S. Cl. ..... 60/371; 60/413; 91/418; 92/134

[51] Int. Cl.[2] ..... F15B 1/02; F15B 15/18

[58] Field of Search ..... 60/371, 413, 473; 92/134; 91/418; 173/1

[56] References Cited

UNITED STATES PATENTS

| | | | |
|---|---|---|---|
| 361,169 | 4/1887 | Lowrie | 91/325 |
| 580,154 | 4/1897 | Bullock | 92/142 |
| 2,548,439 | 4/1951 | Moffett | 91/5 |
| 2,742,929 | 4/1956 | Treseder | 92/134 |
| 2,807,021 | 9/1957 | Chellis | 92/134 |
| 2,960,072 | 11/1960 | Arnes | 92/142 |
| 3,411,592 | 11/1968 | Montabert | 91/321 |
| 3,509,723 | 5/1970 | Dorn | 60/413 |
| 3,531,065 | 9/1970 | Brown | 92/134 |
| 3,734,863 | 6/1973 | Wohlwend | 91/321 |
| 3,892,279 | 7/1975 | Amtsberg | 60/371 X |

*Primary Examiner*—Edgar W. Geoghegan
*Attorney, Agent, or Firm*—Arnold B. Silverman

[57] ABSTRACT

A hammer and more particularly a fluid operable hammer wherein alternating impetus provided by pressurized liquid and gas means actuates a reciprocable hammer piston to generate repetitive impact loads.

5 Claims, 5 Drawing Figures

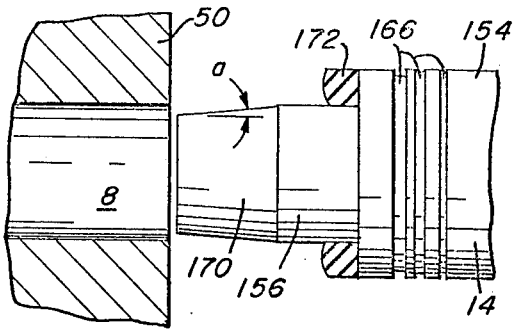
FIG. 2
FIG. 3
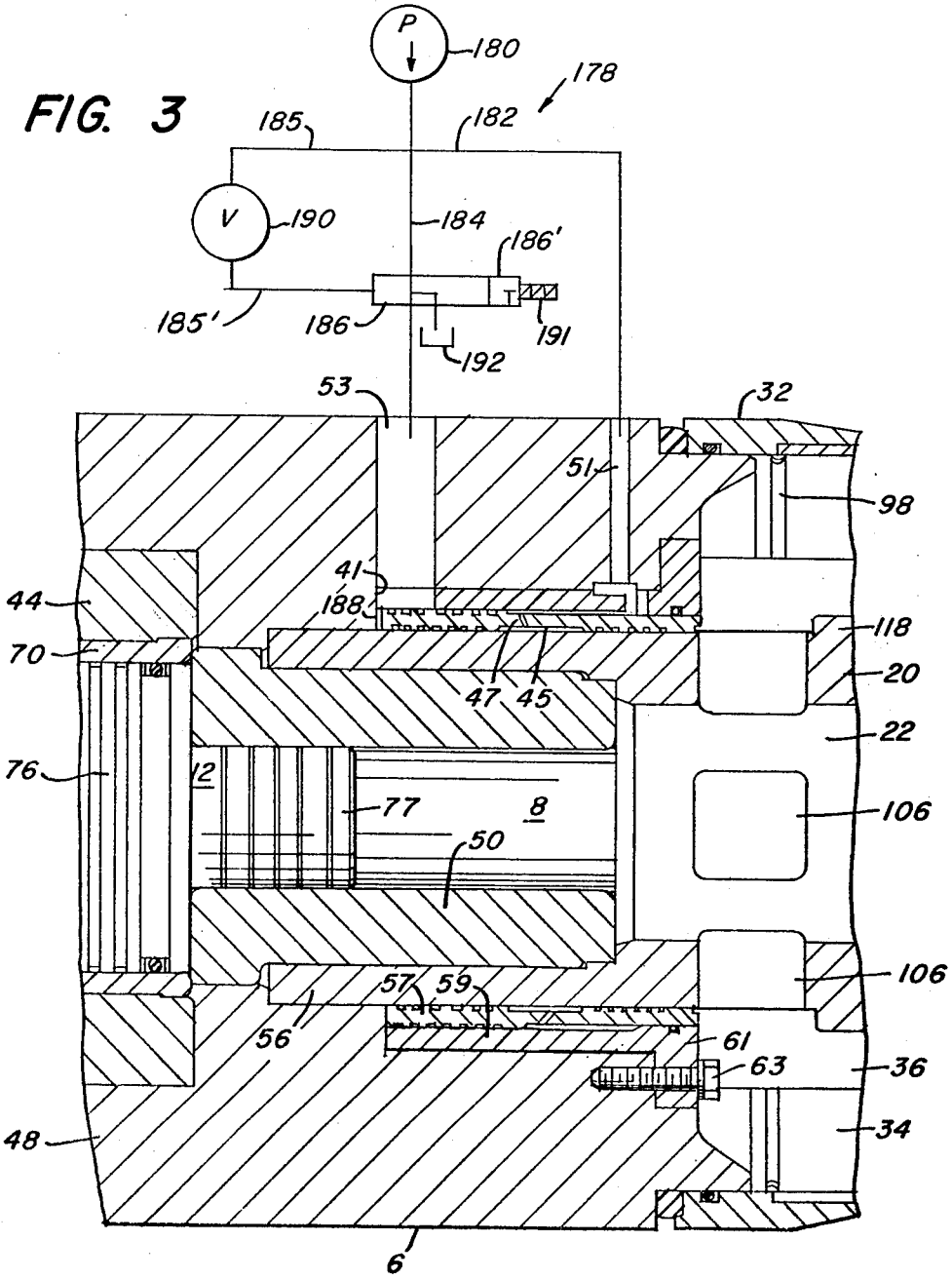

HAMMER

This is a division of application Ser. No. 478,289, filed June 11, 1974, now abandoned.

In the art of percussive tools there is known a wide variety of fluid operable hammers such as rock hammers wherein a well known cutting or breaking bit and striking bar assembly is cooperable with a reciprocable hammer piston to deliver repetitive impact loads to a rock face or other work surface. An example of one such rock hammer is that disclosed by U.S. Pat. No. Re. 27,244. Such a rock hammer is customarily carried by an articulated boom portion of a suitable mobile base such as a crawler frame and rendered pivotally movable with respect thereto as by well known hydraulic jacks whereby the bit may be selectively positioned adjacent a rock face to deliver repetitive impact blows thereto in a well known manner for the consequent cutting or breaking thereof.

The present invention contemplates various improvements over such known rock hammers, for example: major hammer elements such as the hammer piston, cylinder, accumulator and exhaust chamber are generally annular or cylindrical in form and are coaxially aligned and nested thereby providing a compact overall hammer design; an improved main control valve means formed as an annular sleeve and disposed generally coaxially with other major hammer elements is cooperable with fluid actuating means to power the hammer piston through an upstroke cycle portion; and an improved gas charged energy absorbing accumulator arrangement powers the hammer piston through a downstroke or impact stroke cycle portion. The rock hammer of the present invention additionally includes: cushion and delay valve means located adjacent the hammer backhead which are cooperable with the energy absorbing accumulator to provide improved hammer piston cycling; an improved hammer piston design; and novel means for protecting major hammer components from damage due to a misdirected impact blow or a loss of striking bar cushion pressure.

Figure 1A:
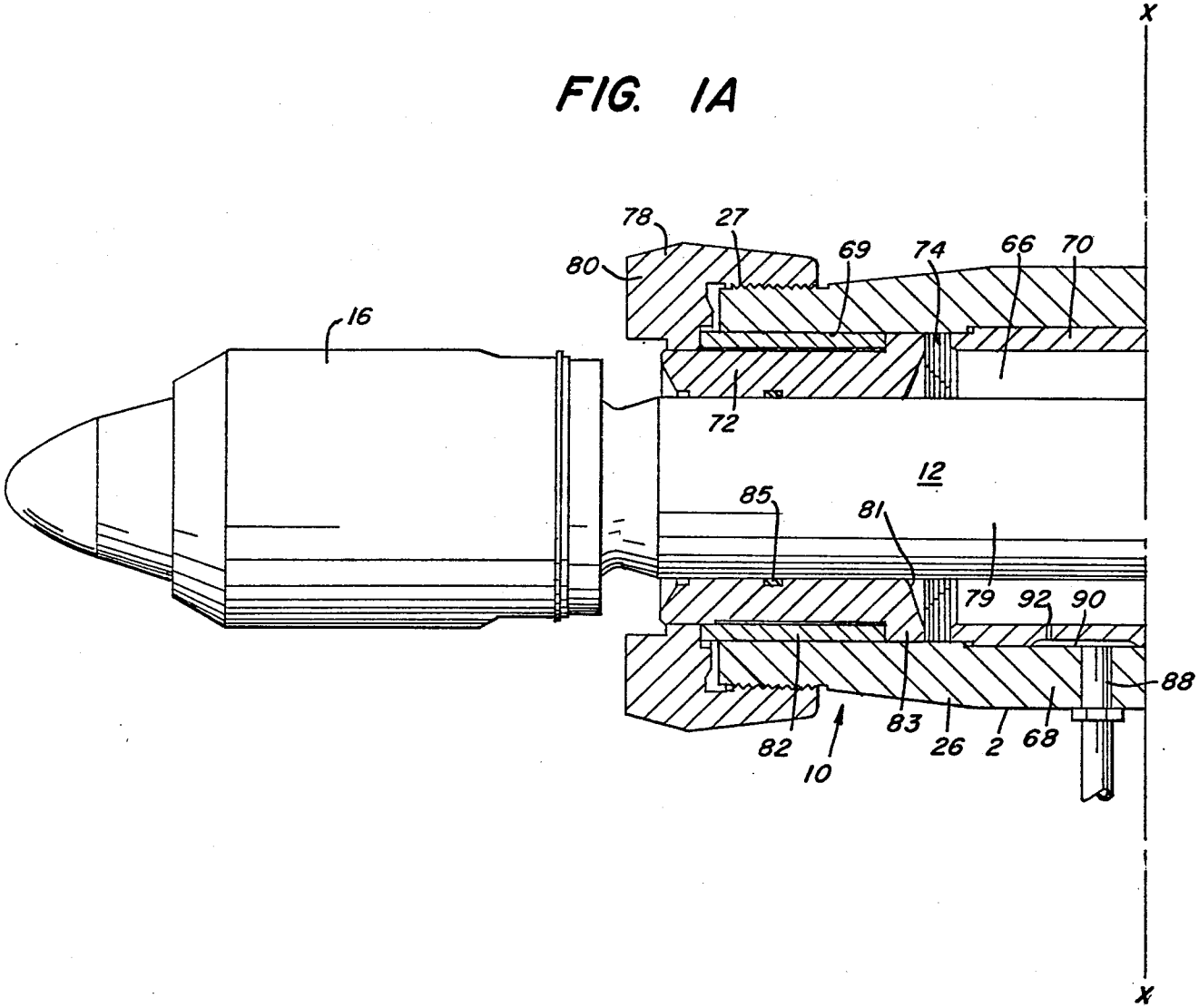
Figure 1B:
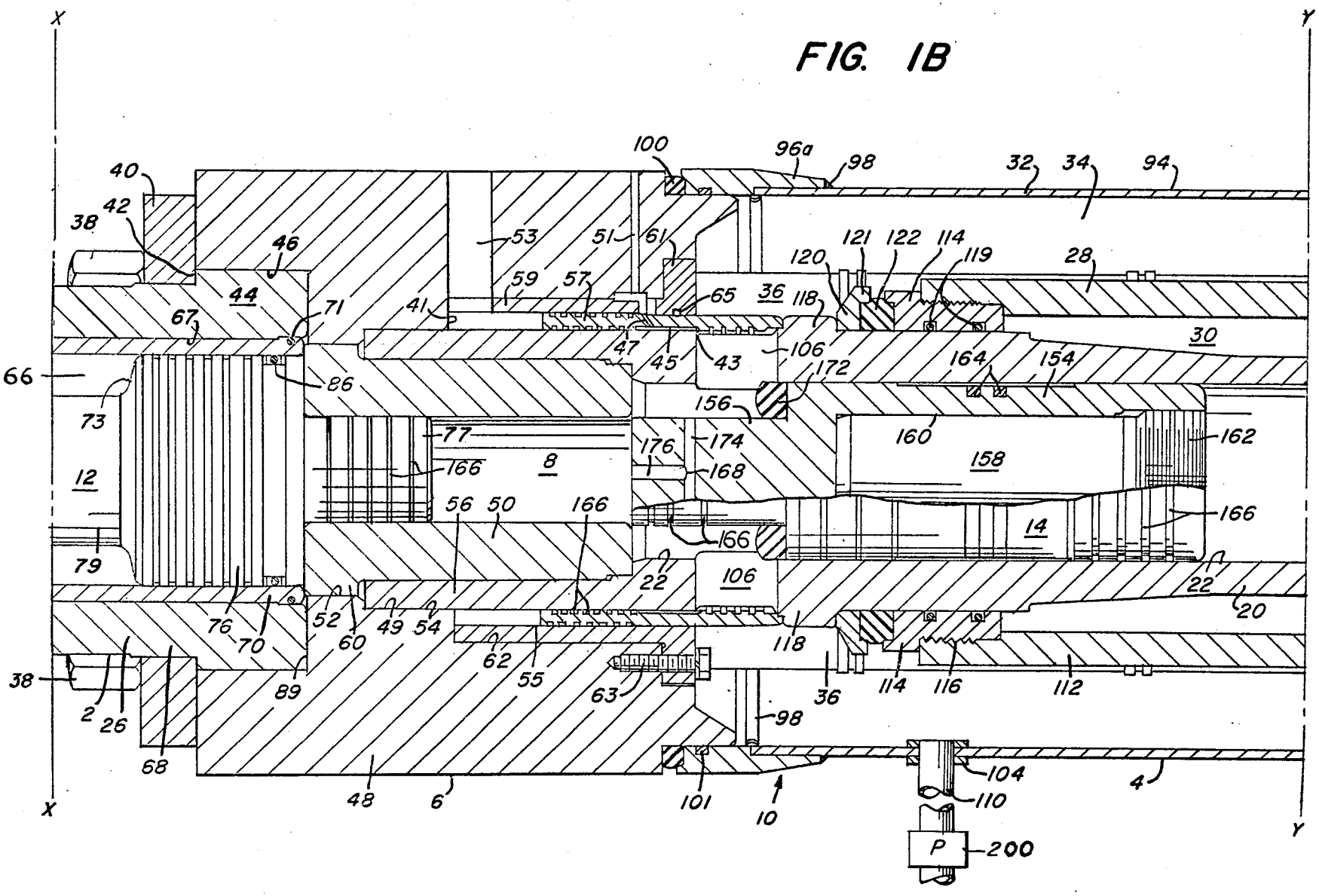
Figure 1C:
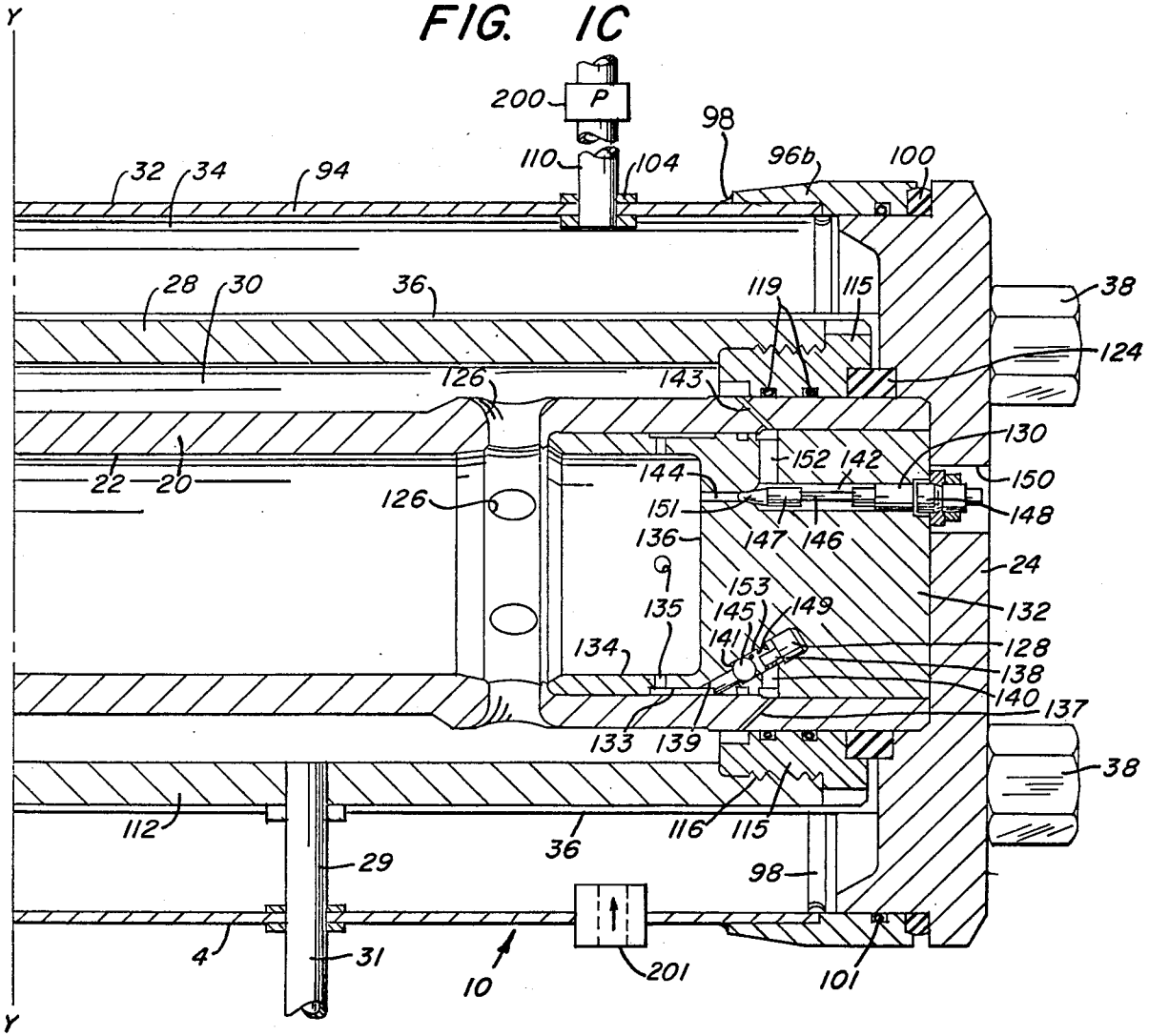

These and other objects and advantages of the present invention are more completely specified in the following description and illustrations, in which:

FIGS. 1A, 1B and 1C taken together constitute a longitudinal section of a rock hammer constructed in accordance with the principles of the present invention;

FIG. 2 illustrates in schematic a portion of the hammer piston and pressure chamber shown in FIG. 1B; and FIG. 3 illustrates partly in section and partly in schematic a portion of the rock hammer of FIG. 1B including the annular control valve of FIG. 1B in the open position thereof and a simplified fluid actuating circuit therefor.

There is generally indicated at 10 in respective FIGS. 1A, 1B and 1C the forward, central and rearward portions of a percussive rock hammer constructed in accordance with the principles of the present invention. The portions illustrated are joined at respective match lines X—X and Y—Y to form the rock hammer 10. Typically hammer 10 is pivotally carried by a boom portion of any suitable mobile base such as a crawler frame (not shown) or the like and rendered movable with respect thereto for example by well known hydraulic jacks carried by such a mobile base whereby the hammer 10 may be selectively positioned adjacent a rock face or other work surface and actuated such as by fluid means to deliver impact blows thereto in the customary manner for the consequent cutting or breaking thereof.

Rock hammer 10 comprises: an elongated generally annular chuck portion 2 (FIGS. 1A and 1B); an elongated generally annular hammer portion 4 (FIGS. 1B and 1C) spaced coaxially rearwardly from chuck portion 2; and a generally annular pressure chamber portion 6 (FIG. 1B) extending coaxially intermediate portions 2 and 4 and rigidly secured thereto.

Chuck portion 2 comprises: an elongated, generally annular chuck housing assembly 26 having an inner space 66; and a generally cylindrical striking bar 12 slideably carried coaxially therewithin and having a well known bit assembly 16 rigidly and releasably affixed adjacent a forwardly extending end portion thereof.

Hammer portion 4 comprises: an elongated cylinder portion 20 having a stepped axial through bore 22 which slideably carries therewithin a generally cylindrical hammer piston 14; an elongated annular energy absorbing accumulator housing portion 28 disposed coaxially with cylinder 20 and encompassing an outer peripheral portion thereof whereby an accumulator space 30 is defined radially intermediate portions 20 and 28; and an elongated annular exhaust chamber or expansion tank portion 32 disposed coaxially with accumulator housing 28 whereby a fluid exhaust space 34 is defined radially intermediate portions 28 and 32. Hammer portion 4 additionally includes: a rearward end member 132 sealingly disposed within a rearward end portion of bore 22 and having therein cushion valve means 128 and delay valve means 130 which are cooperable with suitable fluid actuating means in a manner to be described hereinbelow to control the reciprocation of piston 14; and a backhead 24 disposed rearwardly adjacent member 132 and sealingly engaging the rearwardmost extremities of cylinder 20, accumulator 28 and exhaust chamber 32.

The pressure chamber portion 6 comprises: a generally annular pressure chamber housing 48 having a stepped cylindrical inner periphery 49; a generally annular pressure chamber liner 50 carried coaxially within housing 48 and including a radially outwardly extending forward end flange portion 60 disposed radially adjacent a peripheral portion 52 extending intermediate the axial ends of periphery 49; a cylindrical high pressure chamber 8 defined within liner 50 and communicating coaxially with bore 22; and a valve portion 55 carried coaxially within the housing 48.

In assembly of the rock hammer portions hereinabove described a forward end portion 56 of cylinder 20 is sealingly received radially intermediate liner 50 and a portion 54 of periphery 49 extending rearwardly of peripheral portion 52, and a rearward end portion 44 of chuck housing assembly 26 is sealingly received within housing 48 radially adjacent a forward end portion 46 of periphery 49 and in abutment with an annular seat 89 formed at the intersection of periphery portions 46 and 52.

The hammer assembly as described is rigidly maintained by means of an annular collar 40 which encompasses a peripheral portion of assembly 26 and is adapted to engage a forwardly facing annular seat 42 of portion 44 and further adapted to receive a plurality of elongated fastener assemblies such as longitudinally extending side bars 36. Each of bars 36 extends successively through suitably sized aligned bores in collar 40, body 48 and backhead 24 and has nuts 38 threadedly engaging respective axial ends thereof whereby respective rock hammer portions 2, 4 and 6 are rigidly and releasably secured in the respective assembled positions thereof as described and the accumulator portion 28 and exhaust chamber portion 32 are captively retained coaxially with cylinder 20.

The description provided heretofore of the hammer 10 has been directed to a broad overview thereof wherein major elements have been defined. The following paragraphs describe in detail the structure and operation of the hammer 10 broadly defined hereinabove.

Referring again to FIGS. 1A, 1B and 1C it is seen that the chuck housing assembly 26 includes an elongated generally annular housing member 68. Housing 68 carries therewithin an elongated sleeve 70 which abuts the forwardmost end of liner 50 adjacent flange 60 and extends coaxially forwardly therefrom within the housing 68 is sealing engagement with a rearward inner peripheral portion 67 thereof as by means of an annular seal 71 disposed radially therebetween.

A generally annular frangible bushing member 72 is sealingly disposed coaxially within housing 68 adjacent a forward inner peripheral portion 69 thereof and spaced forwardly from sleeve 70 by a plurality of frangible spring washers 74 captively retained coaxially therebetween. The bushing 72 is captively retained within housing 68 forwardly adjacent washers 74 by a generally annular chuck nut 78 which rigidly and releasably engages a forward outer peripheral portion of housing 68 as by threads 27 and has a radially inwardly extending flange portion 80 which retains the bushing 72 by means of an annular sleeve bearing 82 disposed radially intermediate peripheral portion 69 and bushing 72 and extending coaxially intermediate flange 80 and a rearward radially outwardly extending flange portion 83 of bushing 72. The washers 74, bushing 72, sleeve bearing 82 and nut 78 are adapted in a manner to be described hereinbelow to dissipate the kinetic energy of striking bar impacts thereupon which may occur is such extraordinary circumstances as for example, a misdirected blow upon a rock face or a loss of striking bar cushion gas pressure.

The striking bar 12 carried within the housing 68 includes: an enlarged diameter cylindrical guide portion 76 extending intermediate the axial ends of bar 12 and slideable within the sleeve 70; an elongated cylindrical shank portion 79 which is affixed rigidly to portion 76 and extends coaxially forwardly therefrom through washers 74 and is slideable within an inner peripheral portion of bushing 72, and which further extends coaxially forwardly to the bit assembly 16 affixed adjacent the forwardmost end thereof; and a cylindrical stem portion 77 affixed rigidly to the portion 76 and extending coaxially rearwardly therefrom. Striking bar 12 is axially movable within housing assembly 26 intermediate a rearward position whereat stem 77 is sealingly and slideably disposed within chamber 8 as illustrated in FIG. 1B, and a foward position (not shown) whereat a generally transverse forward annular face 73 of portion 76 contacts washers 74.

Suitable annular seals disposed intermediate adjacent peripheral portions of bushing 72 and shank 79 as at 85, an intermediate guide portion 76 and sleeve 70 as at 86 provide sealing engagement between the respective adjacent peripheries and thereby define respective forward and rearward boundries of the space 66. The space 66 being thus sealed as described is adapted to receive a charge of pressurized gaseous fluid such as air or nitrogen through a port 88 extending radially within housing 26 and communicating with a longitudinal groove 90 extending upon the outer periphery of sleeve 70 intermediate the axial ends thereof and further communicating with space 66 via a radially extending port 92 in sleeve 70 which communicates intermediate space 66 and groove 90. As is evident from the structure defined hereinabove, the volume of space 66 is adapted to be variable in response to movement of the striking bar 12 intermediate its extreme axial positions as described, and therefore the pressurized gas charge within space 66 acts to cushion forward travel of striking bar 12, which cushioning effect is described hereinbelow.

In pressure chamber portion 6 the valve portion 55 encompasses cylinder portion 56 radially inwardly adjacent a portion 62 of periphery 49 which extends intermediate peripheral portion 54 and the rearward end of the housing 48. Valve portion 55 includes: an annular sleeve-like valve member 57 which encompasses the cylinder portion 56 as described and is longitudinally movable with respect thereto intermediate a forward position and a rearward position to control liquid flow to and from bore 22; an annular guiding sleeve member 59 disposed radially intermediate the valve 57 and peripheral portion 62 and captively retained intermediate a forwardmost transverse end 41 of periphery portion 62 and an annular flange member 61 rigidly affixed adjacent the rearward end of housing 48 as by a plurality of circumferentially spaced bolts 63. Flange 61 additionally encompasses and sealingly engages an outer peripheral portion of valve 57 as by means of an annular seal 65 disposed radially therebetween.

The valve portion 55 additionally includes: passageway means 51 and 53 which extend radially in housing 48 and communicate intermediate member 57 and any suitable fluid actuating means such as the circuit generally indicated at 178 (FIG. 3); an annular groove 45 encompassing an inner peripheral portion of valve member 57 intermediate the axial ends thereof; and a plurality of circumferentially spaced bores 47 which extend slantingly radially within member 57 to communicate intermediate an outer peripheral portion thereof and the groove 45. In practice the valve 55 is cooperable with circuit 178 to power hammer piston 14 through a retract or upstroke portion of the hammer operating cycle in a manner to be described hereinbelow.

In hammer portion 4 the exhaust chamber 32 includes an elongated annular body member 94 having respective forward and rearward annular end flange portions **96*a* and 96*b* rigidly and sealingly affixed thereto by any suitable means such as by circumferential weldments 98. The flanges 96*a* and 96*b* are received adjacent respective outer peripheral portions of housing 48 and backhead 24 and are shock mounted thereat as by resilient annular shock member 100 disposed axially intermediate each of flanges 96*a* and 96*b*, and the respective adjacent peripheries of housing 48 and backhead 24. Annular packings 101 are disposed radially intermediate adjacent peripheral portions of housing 48 and backhead 24, and the respective flanges 96*a* and 96*b*** to provide sealing engagement therebetween.

The exhaust space 34 encompassed by chamber 32 communicates intermittently with bore 22 via a plurality of circumferentially spaced ports 106 extending generally radially within cylinder 20 rearwardly adjacent cylinder end portion 56 and adapted to be alternately opened and closed by actuation of valve member 57 whereby the intermittent communication between space 34 and bore 22 is achieved. Space 34 additionally communicates with any suitable exhaust means such as the schematically shown suction pump 200 via a plurality of exhaust ports 104 shown as extending radially within body 94 at circumferentially and longitudinally spaced portions thereof and cooperable conduits such as at 110. In practice during a power stroke of piston 14 liquid is exhausted from bore 22 to space 34 via ports 106 and is subsequently directed to a reservoir (not shown) via ports 104, conduits 110 and pump 200 at such a rate as to preclude flooding of space 34 and thereby minimize exhaust liquid back pressure and prevent explosion of the chamber 34 due to the incompressibility of the liquid in space 34 which would otherwise by pressurized by piston 14 during the impact stroke thereof. Therefore it is important that sufficient vacuum space or compressible gas be present in the chamber 32 at the beginning of each impact stroke to allow the liquid forced out of bore 22 to flow substantially unimpeded into the space 34. Further, in order to permit the entire volume of liquid to flow unimpeded into space 34, it is necessary that the space 34 be of a volume greater than the volume of fluid exhausted thereto during an impact stroke, for example, preferably at least twice the volume of the fluid exhausted per stroke. It is of course to be understood that proper operation of such an exhaust means as described may require a controlled intake of air to space 34 such as through a suitable valve means schematically shown as a check valve 201 communicating intermediate the space 34 and the atmosphere, or by means of controlled air leakage inwardly to space 34 over seals 101.

It is to be understood that in addition to defining the radially outermost boundry of space 34, the chamber 32 also provides a protective sheel to shield accumulator housing 28 from external damage such as dents or scratches which could result for example from flying rock chips or other debris generated during hammer operation. Such shielding is of considerable importance inasmuch as the housing 28 is highly stressed in practice due to the high gas pressure developed within space 30 and therefore even minor scratches or dents in the exterior surface of housing 28 could cause excessively high stress concentrations and conceivably precipitate catastrophic failure thereof.

The accumulator housing 28 includes an elongated annular body member 112 having respective forward and rearward annular end flange portions 114 and 115 rigidly and sealingly affixed adjacent respective forward and rearward axial ends thereof as by mating threads 116. In assembly, the flanges 114 and 115 encompass longitudinally spaced peripheral portions of cylinder 20 whereby housing 28 is captively retained intermediate backhead 24 and a radially outwardly extending annular flange portion 118 of cylinder 20 located rearwardly adjacent the ports 106. An annular shock mount 121 comprising a resilient annular shock member 122 seated upon a rigid seating member 120 encompasses cylinder 20 and is captively retained intermediate flanges 118 and 114 and in similar fashion a resilient annular shock member 124 encompasses cylinder 20 axially intermediate flange 115 and backhead 24 to provide capacity to absorb axial shock loads imposed upon the accumulator housing 28. Annular seals 119 are provided radially intermediate adjacent peripheral portions of the flanges 114 and 115 and the cylinder 20 to provide sealing engagement therebetween. Housing 28 additionally includes a charging port 39 which extends radially therethrough and further extends through space 34 and chamber 32 and is adapted as by means of a conduit 31 to communicate intermediate space 30 and a suitable source of pressurized gaseous fluid such as a nitrogen bottle (not shown).

Accumulator space 30 additionally communicates with the cylinder bore 22 via plurality of circumferentially spaced ports 126 spaced rearwardly from ports 106 and extending radially within cylinder 20 whereby in practice a charge of pressurized gas contained within the space 30 actuates piston 14 through a power stroke or impact stroke portion of the hammer cycle in a manner to be described hereinbelow.

Referring now to FIG. 1C, the member 132 includes an axial bore portion 134 which extends rearwardly from the forwardmost end of the member 132 to terminate adjacent a transverse face 136. The bore portion 134 communicates openly with bore 22 and has a diameter slightly smaller than that of the bore 22 to receive the piston 14 therewithin in closely slideable, sealing engagement. Bore portion 134 communicates with accumulator space 30 via valve means 128 and 130 whereby in practice the piston 14 is actuated through respective cushion and delay stroke portions of the hammer cycle in a manner to be described hereinbelow.

The cushion valve 128 comprises: a spring biased ball check valve mechanism 138 including a ball 145 and a helical spring 149 disposed within a bore 153 so as to permit unidirectional fluid flow therethrough; passageway means 139 communicating intermediate bore 153 and bore portion 134 and including an annular groove 133 which encompasses an outer peripheral portion of member 132 and communicates with the bore portion 134 intermediate the axial ends thereof via a plurality of circumferentially spaced radially extending ports 135; generally radially extending passageway means 140 communicating intermediate bore 153 and accumulator space 30 and including a slantingly radial passage 137 extending within cylinder 20; and a seat portion 141 located intermediate passageway means 139 and bore 153 upon which ball 145 seats. In practice the valve 128 permits gas flow from bore portion 134 to space 30 during a cushion stroke cycle portion in response to applied pressure which unseats the ball 145 from seat 141 against the biasing force of spring 149. Contrary gas flow from space 30 through valve 128 to bore portion 134 is precluded by firm seating of the ball 145 on seat 141 in response to the biasing force of spring 149.

Delay valve 130 comprises: a longitudinally extending passage 142 having an orifice 144 adjacent the forward end thereof which communicates with bore portion 134 at transverse face 136; and a needle valve mechanism 146 extending axially within passageway 142 and having a needle 147 disposed adjacent a seat 151 located intermediate orifice 144 and passage 142. The position of needle 147 is adjustable with respect to seat 151 as by an adjusting screw portion 148 of mechanism 146 disposed adjacent the rearwardmost end thereof and accessible through a suitable opening 150 in backhead 24. Delay valve 130 additionally includes a generally radially extending passageway means 152 which communicates intermediate passage 142 and the accumulator space 30 and includes a slantingly radial bore 143 extending within cylinder 20. In practice the needle valve 130 is operable to meter a flow of pressurized gas from space 30 into cylinder bore portion 134 during a delay stroke cycle portion at a rate determined by the setting of the adjusting screw 148.

As noted hereinabove, many of the hammer elements described heretofore are cooperable to reciprocate hammer piston 14 through the various cycle portions including successively in each cycle a retract stroke, a cushion stroke, a delay stroke and a power stroke. Piston cycling is also controlled in part by the structure of the piston 14 itself as described in the following paragraphs.

The piston 14 comprises: a generally cylindrical, hollow body member 154; a stem portion 156 rigidly affixed adjacent the forward end of body 154 and extending forwardly therefrom; and a core 158 shown as a cylindrical solid form carried within a cylindrical inner peripheral portion 160 of body 154 and rigidly retained therewithin as by a cap 162 threadedly or otherwise rigidly releasably retained within a rearward end portion of periphery 160. The core 158 may be formed from any suitable material of greater or lesser density than the body 154 which is typically formed from such material as steel, whereby capability is provided to produce a piston having variable mass or weight. Core 158 may take any geometric form or arrangement of forms consistent with design limitations and with the requirement that the piston center of mass must coincide with the longitudinal axis of the piston 14. This may include such arrangements as, for example, a plurality of piston core elements spaced circumferentially about the piston axis.

Piston 14 also includes suitable sealing means such as annular seals 164 which provide sealing engagement between radially adjacent peripheral portions of body 154 and bore 22, or a plurality of labyrinth sealing grooves 166 encompassing selected peripheral portions of the body 154. Ideally the grooves 166 are of differing depth, width, separation and cross sectional configuration as illustrated schematically in FIG. 2 to provide maximum sealing efficacy. Such variation in groove configuration improves sealing characteristics over conventional labyrinth seals by requiring varying flow patterns, pressure and density of a fluid stream tending to leak across the grooves 166. This in turn dissipates energy which would otherwise be expended in forcing the fluid stream to lead across the sealed interface. Labyrinth groove seals 166 may be employed to seal various other potential fluid leakage paths in hammer 10 such as adjacent peripheral portions of liner 50 and piston stem 156 or striking bar stem 77, or selected peripheral portions of valve 57 as shown.

By reference to FIGS. 1B and 2 it will be seen that piston 14 further includes: passageway means 168 extending within stem portion 156; an inwardly and forwardly extending tapered portion 170 of stem 156; and an elastomeric head portion 172 encompassing a rearward portion of stem 156 adjacent body 154.

As shown the passageway means 168 include a longitudinal bore 176 communicating coaxially intermediate the forwardmost end of stem 156 and a transverse bore 174 which extends radially within stem 156 intermediate diametrically opposed sides thereof whereby the passageway means 168 communicate intermediate the forward transverse end of stem 156 and an outer peripheral portion of the stem 156 spaced rearwardly therefrom to provide a fluid flow path which improves piston impact characteristics in a manner to be described hereinbelow.

Taper 170 extends outwardly and rearwardly from the forwardmost end of stem 156 to a point longitudinally intermediate bore 174 and body 154, and comprises a taper angle with respect to the longitudinal axis of stem 156 of approximately 0 to 2 degrees as indicated at A (FIG. 2). Like bores 174 and 176, the taper 170 provides a controlled fluid leakage path which improves impact characteristics of the piston 14.

In practice the piston 14 is reciprocable by cooperable pressurized liquid and gas actuating means between a rearward position adjacent face 136 and a forward position whereat stem 156 extends into chamber 8. In FIG. 1B the piston 14 is shown intermediate its extreme forwardmost and rearwardmost positions.

The fluid reciprocating means utilized to actuate piston 14 include a charge of pressurized gas contained within accumulator space 30 and the hydraulic circuit 178 which is shown as a pressure responsive triggering system comprising a suitable source of pressurized liquid flow such as a pump 180 which communicates with respective rearward and forward portions of the valve member 57 through respective conduits 182 and 184 extending intermediate pump 180 and the respective passages 51 and 53. Circuit 178 additionally includes: a well known shuttle valve 186 which is cooperable with the pump 180 to intermittently direct liquid flow through conduit 184 and passage 53 to an annular chamber 188 located adjacent surface 41; and any suitable pressure responsive control valve 190 which, as shown, is disposed in line with a conduit 185 communicating intermediate pump 180 and an actuating port of valve 186 to operate the valve 186 in the hereinbelow described manner. The circuit 178 is operable to move valve 57 intermediate the extreme rearwardmost and forwardmost positions thereof and is simultaneously operable to alternately direct liquid flow from pump 180 into bore 22 via conduit 182, passage 51, bores 47 and groove 45. The rock hammer 10 as hereinabove described is thus adapted by means of the circuit 178 and a pressurized gas charge in accumulator space 30 to repetitively impact piston 14 upon striking bar 12 by reciprocation of the piston 14 in the following manner.

Prior to operation of hammer 10 the accumulator space 30 and the portion of bore 22 rearward of piston 14 which communicates therewith via ports 126 are charged with gaseous fluid such as air or nitrogen to a pressure of for example approximately 1000 to 2000 psi through conduit 31 and port 29. The space 66 is charged at least to the maximum accumulator pressure attained during a piston upstroke with gaseous fluid introduced via port 88. The gas pressure source used (not shown) is removed upon the conclusion of the charging of spaces 30 and 66 and the ports 29 and 88 are closed as by suitable valves (not shown) whereby the respective charges of pressurized gas are sealed within spaces 30 and 66 by such valves and by suitable sealing arrangements as described hereinabove.

An alternate charging arrangement not shown here comprises a conduit openly communicating intermediate ports 88 and 29 whereby a charge of pressurized gas is supplied simultaneously to both spaces 66 and 30 via a suitable port in such a conduit and the respective ports 88 and 29. Upon the conclusion of charging such charging port is closed by any suitable valve and the gas charge is thus sealed within spaces 30 and 66 and within the conduit communicating therebetween. In this configuration the spaces 30 and 66 comprise in effect axially spaced portions of a single energy absorbing accumulator with passageway means openly communicating therebetween.

Piston 14 is shown in FIG. 1B at its position early in an upstroke cycle portion. The valve 57 is being maintained in the closed position as shown, in FIG. 1B by means of liquid flow from pump 180 to chamber 188 via conduit 184, valve 186 and passage 53. It is to be noted that at this stage of the hammer cycle the position of valve 186 is in the alternative position from that shown in FIG. 3 in which it provides a flow path therethrough as shown schematically at 186', which valve position is maintained such as by a conventional compression spring bias 191. Liquid flow from pump 180 is also being directed into that portion of bore 22 forward of piston 14 and into chamber 8 via conduit 182, passage 51, bores 47, and thence longitudinally rearwardly within groove 45 to a rearward end portion 43 thereof which overlaps a part of the ports 106. The liquid flow thus provided urges piston 14 rearwardly against the pressure of the gas contained within accumulator space 30 and in the communicating portion of bore 22 rearward of piston 14, and thereby develops an increasing liquid pressure in conduit 182 in response to compression of the accumulator charge. The liquid pressure so developed is transmitted via conduits 182 and 184, and the valve 186 to chamber 188 whereby valve 57 is urged rearwardly into firm abutment with flange 118 to maintain sealing closure of the ports 106 and thereby preclude liquid leakage therethrough from the bore 22 to space 34. Additionally, the increasing liquid and gas pressures acting upon opposing axial ends of piston 14 cooperate to elastically deform head portion 172.

The upstroke cycle continues as described until the rearward end of piston 14 passes ports 126 whereupon compression of the gas charge in space 30 via the ports 126 ceases and a cushion stroke commences during which the piston 14 is urged farther rearward into bore portion 134 to direct the pressurized gas intermediate piston 14 and face 136 to space 30 via valve 128 in response to the continuing liquid flow into bore 22 from circuit 178 as hereinabove described. The considerably reduced flow area through valve 128 as compared to that of ports 126 and the increased flow resistance offered by valve mechanism 138 cooperate to reduce the upward velocity of piston 14 during the cushion stroke. Additionally, a greatly reduced radial clearance between body 154 and bore portion 134 as compared to that between body 154 and bore 22 reduces peripheral leakage of gas and thereby further reduces piston velocity.

As the rearward end of piston 14 passes ports 135 a volume of gas is trapped intermediate the piston 14 and face 136 to act as a cushion to preclude impact of piston 14 upon the face 136 thereby terminating the upstroke travel of the piston 14. A small portion of such trapped gas is directed into surface 30 via valve 130 as the piston cushion stroke ends. It will of course be understood that at all times during piston upstroke travel the gaseous charge in space 66 acts upon face 73 of striking bar 12 to urge the striking bar 12 rearwardly against the increasing liquid pressure within bore 22 and chamber 8 thereby maintaining the bar 12 in the operational position thereof as shown.

In response to the suddenly increased resistance to piston upstroke travel offered by the gas cushion described hereinabove the pressure in circuit 178 and particularly in conduit 185 increases rapidly to a predetermined upper set pressure of valve 190 whereupon the valve 190 opens and the pressure in circuit 178 acts to shift valve 186 to the position illustrated in FIG. 3 thereby dumping circuit 178 flow through the valve 186 and thence to a reservoir 192. In response thereto the liquid in chamber 188 which had maintained valve 57 firmly closed throughout the upstroke and cushion strokes is released to reservoir 192 and the pressurized liquid within bore 22 acts first upon the forward end of groove 45 and subsequently upon a rearwardmost end of valve 57 to begin shifting valve 57 forwardly to the open position thereof. The ports 106 thus begin to open and the liquid within bore 22 beings flowing into space 34, being given an initial impetus by the release of elastic energy stored in the elastomeric piston head portion 172. The release of elastic energy from head portion 172 additionally provides a reaction force which thrusts the piston 14 slightly rearwardly.

In response to the initial opening of ports 106 the liquid pressure in bore 22 decreases rapidly and substantially simultaneously a delay stroke of piston 14 begins during which gas compressed within space 30 is metered into bore portion 134 behind piston 14 via valve 130. During the delay stroke only the gas flow from valve 130 acts on piston 14 inasmuch as valve 128 precludes reverse gas flow from space 30 to bore 134 as noted hereinabove and ports 126 are closed.

Piston 14 moves forwardly at a relatively slow rate under the impetus of the gas flow from valve 130 for the duration of the delay stroke, for example approximately 30 to 40 milliseconds, during which time the valve 57 continues opening.

It is to be understood that by adjustment of valve 130 as described hereinabove the duration of the delay stroke may be varied as required by such considerations as, for example the peak gas pressure in accumulator space 30 and the time required for valve 57 to open fully.

The delay stroke terminates when the rearward end of piston 14 uncovers ports 126 whereupon the piston 14 is exposed to the full force of the gas previously charged into accumulator space 30 and is thus impelled forward in a power stroke thereof under the impetus of free flow of the highly pressurized gas into bore 22 via ports 126. Substantially simultaneously the opening of valve 57 is completed and the advancing piston 14 forces the liquid in bore 22 ahead of it into the space 34 via ports 106. The space 34 is substantially larger in volume than bore 22 and inasmuch as a suitable exhaust pump (200) communicating therewith via ports 104 and conduits 110 precludes flooding of space 34 as mentioned hereinabove, the piston 14 encounters negligible liquid back pressure during its power stroke.

Under the continuing impetus of accumulator pressure as described the piston 14 is impelled forward to a position whereat stem 156 is about to enter chamber 8. At this point the piston 14 has forced most of the liquid from bore 22 through ports 106 and by virtue of the generally forwardly directed impetus applied to the liquid has trapped volume of such liquid within the chamber 8 forwardly of piston stem 156. As the power stroke continues under the impetus of accumulator pressure the stem 156 begins to enter chamber 8, such entry being eased by the flow of liquid trapped within the chamber 8 into the bore 22 via passageway means 168. Additionally, the taper 170 ensures a smooth entry of stem 156 into chamber 8 by providing increased clearance radially therebetween at the initial entry and by permitting a controlled leakage of liquid therebetween from chamber 8 to bore 22.

As the piston stem 156 progresses farther into chamber 8 the bore 174 ultimately moves past the rearward end of member 50 and into chamber 8 thereby to be sealed from bore 22 by the radially adjacent periphery of chamber 8. Subsequently the widening of taper 170 adjacent the rearwardmost end of chamber 8 reduces the radial clearance therebetween to a predetermined minimum thus reducing the leakage therebetween in a controlled manner. Hence, the continued forward motion of piston 14 effectively stops liquid leakage therepast from chamber 8 and piston stem 156 thus impacts upon the remaining trapped liquid to generate a high pressure pulse, for example approximately 50,000 to 100,000 psi which is transmitted via stem 77 through striking bar 12 and bit 16 and to a rock face for the consequent cutting or breaking thereof. The previously described labyrinth seal grooves 166 encompassing peripheral portions of stems 156 and 77 further reduce leakage from the chamber 8 during piston impact. At the instant of piston impact within chamber 8 substantially all liquid has been exhausted from bore 22 into the space 34.

Throughout the hammer power stroke as described hereinabove liquid flow from pump 180 is being dumped to reservoir 192. Consequently the pressure in circuit 178 quickly decreases to a lower set pressure of valve 190 whereupon the valve 190 closes and due to conventional surface leakage in valve 186 or any other suitable exhaust means the pressure in the passage 185' is reduced and valve 186 is returned to the position 186' by the spring bias 191. The pump 180 consequently begins to direct liquid flow via conduit 184 and valve 186 to the chamber 188 thereby urging valve 57 rearwardly to close ports 106 and move the bores 47 and communicating groove 45 into communication with passage 51. Liquid flow is thus directed into bore 22 to once again urge piston 14 rearwardly in an upstroke thereof and a cycle of hammer operation is thereby completed.

Regarding the frangible washers 74 and bushing 72 of chuck portion 2, it will be recalled that in practice the pressurized gas charge in space 66 normally urges the striking bar 12 rearwardly and cushions forward travel thereof. If the pressure in space 66 is lost due to failure of pressure seals or a like cause, or if striking bar 12 is thrust forward at a high energy level for example by a misdirected blow, the striking bar 12 will impact upon washers 74 and in response thereto the washers 74 will deform intermediate the slantingly radially extending annular surface 73 and a similarly formed rearward end surface 81 of bushing 72 thereby dissipating the peak kinetic energy of bar 12. If striking bar 12 impacts washers 74 at an extremely high energy level the washers 74 will dissipate substantial energy by being bent or sheared and the bushing 72 will dissipate additional energy by being sheared longitudinally across the base of flange portion 83. The remaining undissipated kinetic energy of bar 12 will subsequently eject the bar 12, fragments of washers 74 and a major portion of bushing 72 harmlessly from the chuck portion 2. In an alternative feasible mode of failure the washers 74 would be severely deformed but not sheared, and the bushing 72 would be thrust forwardly to cause the sleeve bearing 82 or the nut 78, or both to fail. Thus, it is to be understood that bushing 72, washers 74 and bearing 82 not only serve to dissipate peak energy loads, they additionally preclude damage to such major hammer components as chuck housing 26 or chamber housing 48 under such extraordinary circumstances as described hereinabove by failing or by precipitating failure of lesser elements such as the nut 78.

It is to be noted that the hereinabove described alternate configuration wherein spaces 66 and 30 openly communicate via a conduit (not shown) extending therebetween offers an alternate scheme to preclude serious hammer damage in the event of pressure loss in space 66. As is obvious from the structure defined, such pressure loss will in this case depressurize accumulator space 30 via the interconnecting conduit thereby precluding the possibility of subsequent power strokes of the piston 14.

By virtue of the hereinabove described structure an improved and streamlined rock hammer is provided comprising annular cylinder, accummulator and exhaust drawlser portions generally coaxially aligned and nested one within the other, and additionally including an annular sleeve-like main valve which is cooperable with liquid flow means to power a hammer piston in an upstroke thereof, and cushion and delay valve means which are cooperable with a gaseous charge within an energy absorbing accumulator to power the hammer piston is a downstroke or power stoke thereof.

The rock hammer of the present invention additionally includes a hammer piston having a hollow shell with suitable wear properties and a core carried by such shell which may be exchanged for a more or less dense core to alter piston impact energy. The hammer piston additionally includes passageway means in a tapered impact stem portion to provide ease of entry into an impact or pressure chamber and an elastomeric head portion to enhance energy storing and transfer efficiency.

The present invention still further includes frangible means cooperable with a front end chuck portion thereof to absorb peak impact loads of a striking bar impact blow thereupon thereby protecting major hammer components from serious damage.

Notwithstanding the description hereinabove of a specific structure, it is to be understood that various other embodiments and modifications of the present invention are possible without departing from the broad spirit and scope thereof. For example: the main valve 55 may be of widely varying design and may be actuated in numerous ways; the specific configuration of piston 14 including grooves 166, passages 168, and taper 170 is widely variable; the core 158 of piston 14 may be in discrete particulate form such as metal shot; it is contemplated that valve means 128 and 130 could be combined in a single valve mechanism; and the like.

These and numerous other embodiments having been envisioned and anticipated it is requested that the present invention be interpreted with a view to the broad essence thereof and limited only by the scope of the claims appended hereto.

What is claimed is:

1. A fluid operative impacting assembly comprising: an elongated body member having a bore extending longitudinally therein; hammer piston axially movable within said bore to form two axially spaced variable volume chambers therein; an exhaust chamber carried by said body member; valved passageway means in said body member to control fluid communication between one of said variable volume chambers and said exhaust chamber; said one of said variable volume chambers and said exhaust chamber being adapted to receive hydraulic fluid therein; said exhaust chamber having a volume greater than the maximum volume of said one of said variable volume chambers; and pump means communicating with said exhaust chamber for removing hydraulic fluid from said exhaust chamber during said axial movement of said hammer piston at a rate sufficient to allow discharge of hydraulic fluid from said one of said variable volume chambers into said exhaust chamber while maintaining minimum back pressure therein when said one of said variable volume chambers in in fluid communication with said exhaust chamber.

2. A fluid operative impacting assembly as specified in claim 1 wherein said pump means includes a suction pump in fluid communication with said exhaust chamber.

3. A fluid operative impacting assembly as specified in claim 1 additionally comprising check valve means between said exhaust chamber and the exterior thereof for permitting the entrance of ambient air into said exhaust chamber in response to the removal of hydraulic fluid from said exhaust chamber by said pump means.

4. A fluid operative impacting assembly as specified in claim 1 wherein the volume of said exhaust chamber is at least twice as great as the maximum volume of said one of said variable volume chambers.

5. A fluid operative impacting assembly as specified in claim 1 wherein said pump means removes hydraulic fluid from said exhaust chamber at a rate sufficient to remove a volume of hydraulic fluid at least equal to the maximum volume of said one of said variable volume chambers per impact stroke of said hammer piston.

* * * * *